United States Patent [19]

Gallagher

[11] 3,946,353

[45] Mar. 23, 1976

[54] MOUNTING SYSTEM FOR INFRARED TUBES

[76] Inventor: James G. Gallagher, 110 Fell Ave., N. Vancouver, British Columbia V7P 2J9, Canada

[22] Filed: Dec. 11, 1974

[21] Appl. No.: 531,597

[52] U.S. Cl. ..... 338/318; 248/201; 338/273; 338/276; 338/322

[51] Int. Cl.[2] ..... H01C 1/014

[58] Field of Search ..... 338/234, 236, 237, 268, 338/273, 276, 322, 318; 248/201

[56] References Cited

UNITED STATES PATENTS

| | | | |
|---|---|---|---|
| 1,031,787 | 7/1912 | Hallock | 338/318 |
| 2,072,850 | 3/1937 | Andre | 338/273 |
| 2,139,786 | 12/1938 | Wiegand | 338/276 X |
| 2,562,940 | 8/1951 | Packer | 338/236 |
| 2,596,837 | 5/1952 | Calvert | 338/318 X |
| 2,690,491 | 9/1954 | Calvert | 338/236 |

*Primary Examiner*—E. A. Goldberg
*Attorney, Agent, or Firm*—Seed, Berry, Vernon & Baynham

[57] ABSTRACT

A mounting system for an infrared tube or the like. The tube is supported by threaded bolts which axially extend from insulator plugs at each end of the tube. The tube is mounted by inserting one of the bolts into a bore in a mount until the insulator at the end of the tube contacts the inner surface of the mount. The bolt at the other end of the tube is then placed in axial alignment with a bore in another mount and inserted therethrough. The diameter of the bolts is substantially smaller than the diameter of the bores. A cylindrical sleeve having an internal diameter slightly larger than the diameter of the bolts and an external diameter slightly smaller than the diameter of the bores is inserted through each aperture to frictionally engage the bolts with their internal surfaces and the mounts with their outer surfaces. Electrical conductors are then secured to each bolt to supply electrical power to the tube.

10 Claims, 2 Drawing Figures

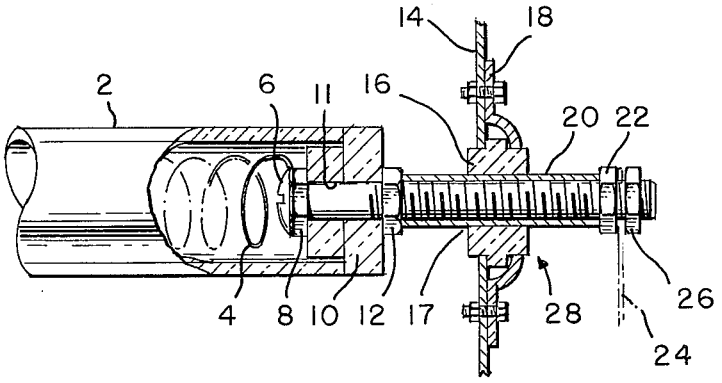
FIG. 1
FIG. 2
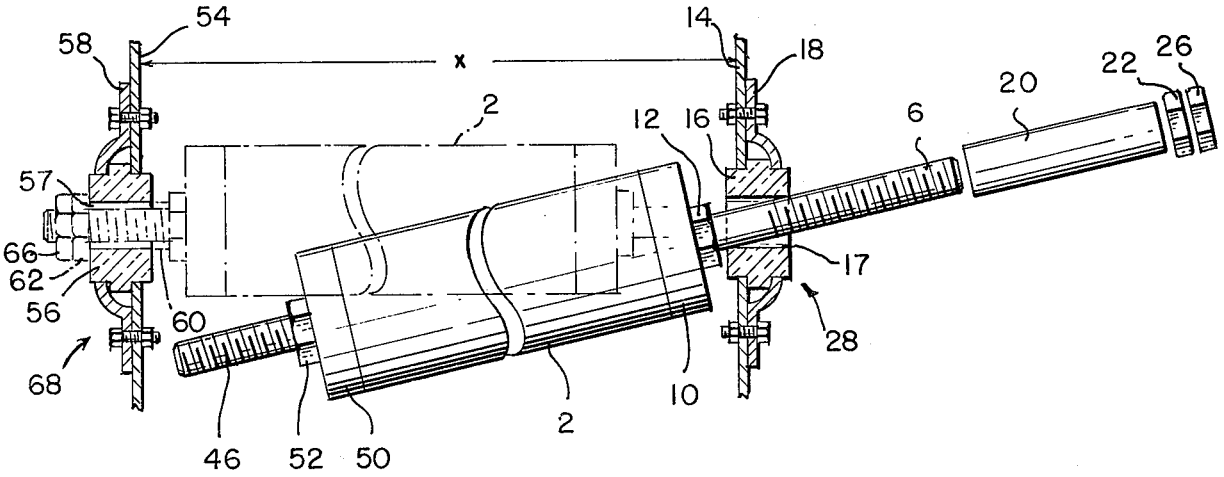

MOUNTING SYSTEM FOR INFRARED TUBES

BACKGROUND OF THE INVENTION

1. Field of the Invention

This invention relates to mounting structures for an infrared tube or the like and, more particularly, to a mounting system wherein an axial extension at each end of the tube serves as an electrical conductor as well as a tube support.

2. Description of the Prior Art

An infrared tube generally has a helical heating coil extending axially from one end of the tube to the other. The ends of the coil are then secured to electric terminals for supplying power to the coil. Mounts are placed at each end of the tube to support the tube in a predetermined position. The mounts should permit quick and easy installation and removal of the tube while at the same time holding the tube securely in place and providing a reliable electrical contact.

Prior art mounting structures are generally incapable of providing all of these features. In order to make the tube readily replaceable, the electrical contacts of the tube are often resiliently urged against the mount contacts. In time, dirt finds its way into the contact area to increase the intercontact resistance.

Prior art tubes having a reliable electrical contact, such as those employing soldering, prevent the tube from being easily replaceable.

SUMMARY OF THE INVENTION

It is an object of the present invention to provide a mounting system for an infrared tube which allows quick and easy installation and removal of the tube from the support structure.

It is another object of the present invention to provide a mounting structure in which a tube may be installed and removed without the use of specialized tools.

It is still another object of the present invention to provide a mounting system for an infrared tube which also provides electrical power to the heating element within the tube.

It is a further object of the present invention to provide a mounting system for an infrared tube that securely supports the tube while allowing the tube mounts to accommodate changes in the dimension of the tube from heating and cooling.

These and other objects of the present invention are accomplished by placing an insulator plug over the ends of a tube. Bolts are then inserted through axial bores in the plugs with their heads in the tube. Finally, the ends of a heating coil extending the length of the tube are fastened to the bolt heads.

A pair of spaced apart mounts are provided having an axial through-bore. The diameter of the through-bores is substantially greater than the diameter of the bolts.

The tube is mounted by inserting one of the bolts through a mount bore at an angle. After the opposite bolt clears the other mount, the tube is rotated upwardly to place the bolts in axial alignment with the bores. The tubes is then moved axially to insert the remaining bolt through its mount bore.

The bolts are frictionally fastened to the mounts by placing a sleeve over each bolt which frictionally engages both the bolts and the inside surfaces of the bores. A pair of electrical leads are then connected to the bolts to complete a circuit through the heating coil.

BRIEF DESCRIPTION OF THE DRAWINGS

FIG. 1 is fragmentary cross-sectional view showing one end of an infrared tube mounted in operating position according to the present invention.

FIG. 2 illustrates in full lines the tube being installed and shows in phantom the installed position of FIG. 1.

DETAILED DESCRIPTION OF THE PREFERRED EMBODIMENTS

Referring to the drawings, a cylindrical glass tube 2 encloses a helical heating coil 4 which extends from one end of the tube to the other. The dimensions of the glass tube 2 are not critical as to the present invention; various lengths and diameters of tubes can be supported by the mounting structure of the invention. Similarly, the thickness of the tube is not critical.

Cylindrical ceramic insulator plugs 10, 50 are provided at the ends of the tube 2 to hermetically seal the interior of the tube from the external environment. Each plug is stepped at an annular shoulder to provide a cylindrical portion of reduced diameter which fits into the interior of the tube 2 while the ends of the tube seat against the annular shoulder. Adhesive means is provided to securely hold the plugs 10, 50 in place and act as a sealant.

As part of the present invention, the plugs 10, 50 are provided with axial bores 11 through which bolts 6, 46 extend. Nuts 8 are threaded onto these bolts to damp the ends of the heating coil between the heads of the bolts and the nuts. The bolts are held against endwise movement relative to the plugs 10, 50 by nuts 12, 52 which bear against the outer ends of the plugs. Sealant is provided between the bolts 6, 46 and the walls of the bores 11 to assist in sealing the interior of the tube 2 from the environment.

Matching mounting assemblies 28, 68 are provided for opposed end plates 14, 54 presented by the surrounding frame (not shown) and having apertures to receive ceramic insulator mount components 16, 56 of the assemblies. These mounts 16, 56 have annular center lands shouldering against the end plates 14, 54 and are held in place by annular clamps 18, 58 which are bolted at their rims to the end plates 14, 54 and have a central outwardly dished portion bearing against the outer shoulder of the annular land of the mounts 16, 56.

The bolts 6, 46 extend through the bores 17, 57 in the mounts 16, 56. These bores are of a diameter greater than the diameter of the bolts 6, 46 to accommodate right and left sleeves 20, 60. As will be presently explained, the radial spaced occupied by the sleeve 20 is essential for installation of the tube assembly. On the other hand, the diameter of the bore 57 in the mount 46 is only larger than that of the bolts 46 for convenience of using matching mounts 16, 56 and bolts 6, 46 of like diameter.

A pair of nuts 22, 62 are threaded onto the bolts 6, 46 and clamp the sleeves 20, 60 against the nuts 12, 52. The axial forces exerted by the nuts 22, 62 force the sleeves 20, 60 against the nuts 12, 52, thereby locking the nuts 12, 52 in position. Similarly, the nut 8 is locked in position against the head of the bolt 6. therefore, the nuts 12, 52 do not exert pressure against the plugs 10, 50 when the sleeve retaining nuts 22, 62 are torqued on the bolts 6, 46. A second pair of nuts 26, 66 are used to clamp electrical leads 24, 64 against the nuts 22, 62.

The manner of installation of an infrared tube according to the present invention is shown in FIG. 2, wherein it will be noted that the bolt 6 extending from the right end of the tube 2 is purposely longer than the bolt 46 projecting from the left end thereof. This is preferred for maximum tube length, as will be hereinafter explained, but is not essential for a practice of the broader aspects of the invention. As indicated in FIG. 2, since the diameter of the bore 17 in the mount 16 is greater than the diameter of the bolt 6 as a consequence of the sleeve 20, the bolt 6 may be inserted through the bore 17 when the tube is tilted at an angle relative to the axis of the bore 17. While the tube is tilted as shown, the bolt 6 is inserted through the bore 17 until the nut 12 contacts the mount 16. The tube assembly is next swung upwardly to place the other bolt 46 in axial alignment with the bore 57 in the mount 56, and the tube assembly is then shifted axially to the left to insert the bolt 46 through the bore 57. Following this step, the sleeves 20, 60 are placed on the bolts 6, 46 and pushed endwise through the bores 17, 57 into engagement with the nuts 12, 52. Then the nuts 22, 62 are threaded into place snugly against the outer ends of the sleeves, thereby clamping the sleeves in place. With this arrangement, the nuts 22, 62 provide fixed seats against which the electrical leads 24, 64 may be clamped by the nuts 26, 66. The completed assembly fixes the tube 2 in place and yet permits limited axial movement thereof if needed because of dimensional changes due to thermal expansion when the tube is hot.

As previously indicated in the illustrated embodiment, the left bolt 46 is shorter than the right bolt 6 to allow the longest possible length for the tube assembly for a given spacing between the insulator mounts 16, 56. Since the bolt 46 must clear the mount 56 to be inserted in the bore 57, the length of the tube assembly (including the plugs 10, 50 and nuts 12, 52), plus the length of that portion of the left bolt 46 which projects beyond the nut 52, must be less than the spacing. Such axial projection of the bolt 46 must be at least as long as the width of the mount 56 plus the combined width of nuts 62, 66. It will be apparent that the maximum length of the tube assembly for an inter-mount spacing is the spacing minus the width of the mount 56 and minus the combined width of nuts 62, 66. This presumes that the spacer 60 is not any longer than the bore 57.

After the left bolt 46 has been inserted through the bore 57 by shifting tube assembly to the left, the right bolt 6 must still extend beyond the mount 16 an amount at least equal to the width of nuts 22, 26. Thus, if matching mounts and nuts are used at both ends, the right bolt 6 must extend beyond the nut 12 at least twice the combined width of mount 16 and nuts 22, 26.

In summary, bolt 6 must be larger than bolt 46 in order to provide the maximum length tube 2 in a given interinsulator spacing a. However, it is to be understood that this invention is not limited to bolts having differing lengths since the infrared tube mounting system of the present invention can be used with tubes having bolts of equal length if tube length is sacrificed for a given spacing between mounting points.

While the left end of the tube is shown as being similar in construction to the right end, this is not necessary for the practice of this invention. Since only one bolt 6 is inserted through the bore 17 at an angle, a sleeve 20 is necessary only for that bolt. The bolt at the left end of the tube can be given a smooth surface and a diameter approximately equal to the diameter of the bore 57. Identical parts are used on both ends of the tube here only for the convenience provided by standardization.

It is now apparent that the infrared tube of the present invention can be quickly and easily installed in the mounting structure by a relatively unskilled person using only a wrench. In addition, the frictional engagement provided by the mounting system of the present invention securely holds the tube in place while permitting thermal expansion and contraction and serves as an electrical terminal for providing power to the infrared tube.

The embodiments of the invention in which a particular property or privilege is claimed are defined as follows:

1. In combination:

first and second axially aligned insulator mounts spaced apart a given distance and each formed with an axial through-bore, an elongated tube containing a coil to be electrically energized, first and second insulator plugs on the ends of said tube and each having an axial through-bore, first and second bolts having their heads within said tube and their shanks extending through said respective plug bores and projecting endwise through said respective mount bores, respective first means on the bolts for holding the ends of said coil beneath the heads of the bolts and for holding the bolts against movement relative to said plugs, a spacer sleeve on the shank of the first bolt and extending into the bore of the first mount, and respective second means threaded into the outer end of the shanks of the bolts for gripping an electrical lead, the axial distance from the outer end of the second bolt to the outer end of the first plug being less than said given distance and the thickness of the sleeve being sufficient to permit the tube to be removed after removal of said second means and the sleeve by first moving the tube axially toward the first mount until the second bolt is free of the second mount, then tilting the tube by way of the play of the first bolt in the bore of the first mount, and finally sliding the tilted tube away from the first mount to free the first bolt therefrom.

2. A combination according to claim 1 in which said first means on each bolt comprises a first set of inner and outer spaced nuts threaded onto the bolt and engaging the inner and outer ends, respectively, of the respective insulator plug, the ends of the coil being clamped between the heads of the bolts and said inner nuts.

3. A combination according to claim 2 in which said second means in each bolt comprises a second set of inner and outer nuts threaded onto the outer end portion of the bolt, said sleeve being clamped between the outer nut of the first set on the first bolt and the inner nut of the second set on the first bolt.

4. A combination according to claim 1 in which there is a second spacer sleeve on the shank of the second bolt and extending into the bore of the second mount.

5. A combination according to claim 4 in which said second means on each bolt comprises a second set of inner and outer nuts threaded onto the outer end portion of the bolt, said first-mentioned sleeve and second sleeve being clamped between the outer nut of the respective first set and the inner nut of the respective second set.

6. A combination according to claim 1 in which said first bolt projects outwardly beyond the first plug farther than the second bolt projects outwardly beyond the second plug by an amount which is greater than the length of the bore through the second mount.

7. The combination according to claim 1 in which said first plug is spaced inwardly from said first mount by a distance greater than the distance from the inner end of the second mount to the outer end of the second bolt.

8. In combination:

an elongated tube, a pair of dielectric plugs on the ends of the tube, each having an axial through-bore, first and second bolts having their heads in the tube and their shanks projecting outwardly through and beyond the bores of said respective plugs, a spacer sleeve receiving said first bolt outwardly of the respective plug, a coil in the tube extending between the heads of said bolts, means for holding said bolts against movement relative to the tube, plugs and ends of the coil, and means threaded onto the first bolt for holding said sleeve against axial movement relative to the first bolt and for gripping an electrical lead.

9. A combination according to claim 8 in which said first-mentioned means comprises a respective first set of inner and outer nuts threaded onto each bolt, with the inner nut clamping the respective end of the coil against the head of the bolt and being seated against the inner end face of the respective end plug and with the outer nut bearing against the outer end face of the respective end plug, said sleeve having its inner end seated against the outer nut of the respective set, and said second-mentioned means including a first nut bearing against the outer end of said sleeve and a second nut for clamping an electrical lead against said first nut.

10. In combination:

a coil a tube housing the coil, a dielectric end plug closing an end of the tube said plug having an axial through-bore, a bolt extending through said plug bore, a spacer on the bolt between the head of the bolt and the plug, one end of the coil being held between said head and the spacer, and the spacer bearing against the plug, a nut threaded onto the bolt and clamping the plug between the nut and the spacer, and a spacer sleeve on the bolt seated against said nut, a second nut threaded onto the bolt and bearing against the outer end of said sleeve, and a third nut threaded onto the bolt clamping an electrical lead against said second nut.

* * * * *